US008136671B1

(12) United States Patent
Daboub et al.

(10) Patent No.: US 8,136,671 B1
(45) Date of Patent: Mar. 20, 2012

(54) DOCUMENT SORT MACHINE HAVING DUAL FEEDERS

(75) Inventors: Brent A. Daboub, Coppell, TX (US); Constantine J. Possis, Lakeville, MN (US)

(73) Assignee: National Presort, Inc., Fort Worth, TX (US)

( * ) Notice: Subject to any disclaimer, the term of this patent is extended or adjusted under 35 U.S.C. 154(b) by 326 days.

(21) Appl. No.: 12/583,310

(22) Filed: Aug. 18, 2009

Related U.S. Application Data

(60) Provisional application No. 61/191,572, filed on Sep. 10, 2008.

(51) Int. Cl.
*B07C 5/00* (2006.01)

(52) U.S. Cl. ..... 209/534; 209/552; 209/584; 209/684; 209/900; 209/922

(58) Field of Classification Search ..... 209/534, 209/552, 584, 684, 900, 922
See application file for complete search history.

(56) References Cited

U.S. PATENT DOCUMENTS

| | | | | |
|---|---|---|---|---|
| 3,905,896 | A | 9/1975 | Jackson et al. | |
| 4,140,627 | A | 2/1979 | Weller et al. | |
| 4,488,610 | A | 12/1984 | Yankloski | |
| 5,363,971 | A | 11/1994 | Weeks et al. | |
| 5,419,457 | A | 5/1995 | Ross et al. | |
| 5,689,795 | A * | 11/1997 | Mastrandrea | 399/407 |
| 6,561,360 | B1 | 5/2003 | Kalm et al. | |
| 6,676,127 | B2 | 1/2004 | Johnson et al. | |
| 7,004,396 | B1 | 2/2006 | Quine et al. | |
| 7,170,024 | B2 | 1/2007 | Burns et al. | |
| 7,414,218 | B2 * | 8/2008 | Wheeler et al. | 209/584 |
| 7,868,264 | B2 * | 1/2011 | Stemmle et al. | 209/584 |
| 2003/0038065 | A1 | 2/2003 | Pippin et al. | |
| 2005/0247606 | A1 | 11/2005 | Redford et al. | |
| 2007/0084764 | A1 | 4/2007 | Benninger | |
| 2007/0209976 | A1 | 9/2007 | Worth et al. | |
| 2008/0041770 | A1 | 2/2008 | Mileaf et al. | |

FOREIGN PATENT DOCUMENTS

WO WO 2006/110486 10/2006

* cited by examiner

*Primary Examiner* — Terrell Matthews
(74) *Attorney, Agent, or Firm* — James E. Walton; Richard G. Eldredge

(57) ABSTRACT

A document sorting machine having dual feeders which feed documents onto common tiers of sort pockets from each end of the machine. The machine includes an induction buffer section which prevents a document already in the transport on a particular tier from colliding with a document being fed into the same transport by a different feeder. Also, the machine includes a serpentine piggy-back unit which can stack consecutive documents going to the same sort pocket.

6 Claims, 4 Drawing Sheets

DOCUMENT SORT MACHINE HAVING DUAL FEEDERS

CROSS-REFERENCE TO EARLIER FILED APPLICATION

The present application claims the priority of U.S. Provisional Application No. 61/191,572, filed Sep. 10, 2008.

DESCRIPTION

1. Technical Field

The present invention relates to a machine used for sorting documents, e.g. mail pieces such as letters, and more particularly relates to a sort machine having a feeder at each end of the machine to increase the sort capacity of the machine.

2. Background of the Invention

For several years, automated "sort machines" have been available which sort large volumes of documents (e.g. letters, postcards, checks, flats, and the like) into groups having a common identifying criteria (e.g. Zip Codes, mail boxes, etc.). A sort machine is typically comprised a "front end" or feeder section and one or more "stacker sections". The front end feeds the pieces, one-by-one, past a reader (e.g. optical character reader ("OCR"), bar code reader ("BCR"), or the like) and onto a transport that carries it to a designated sort pocket in a stacker section(s).

As the piece passes the reader, the desired criteria on a piece is read and a signal is generated that, in turn, is processed to generate a designation signal for that particular piece. This designation signal, in turn, triggers a diverter or "gate" at the designated pocket in the stacker section as the piece approaches to divert the piece from the transport into the designated pocket where it is stacked with other pieces having the same identifying criteria. Such machines are well known and are commercially-available, e.g. Vsort® Flat Sort Machine, NP8000. Sort Machine, both manufactured and distributed by National Presort, Inc., Dallas, Tex.

Many present sort machines are comprised of a plurality of vertically stacked tiers of sort pockets which increase the number of pockets available during a sort operation without substantially increasing the machine's "foot print" (floor area required for the machine). In machines of this type, the letters are read and directed by a Level Distribution Unit or elevator system to the particular tier on which its respective sort pocket is located. For example, if a sort machine has four tiers, only approximately 25% of the letters being fed will go to each tiers. This means that approximately 75% of the sort capacity of each tier goes unutilized. It can be seen that if the unused capacity on each tier can be reduced, the throughput of the machine can be significantly increased.

SUMMARY OF THE INVENTION

The present invention provides a document sorting machine having dual feeders which feed documents onto common tiers of sort pockets from each end of the machine. The machine includes an induction buffer section which prevents a document already in the transport on a particular tier from colliding with a document being fed into the same transport by a feeder. Also, the machine includes a serpentine piggy-back unit which can stack documents going to the same sort pocket.

More specifically, the present invention provides a document sorting machine having an elongated stacker section which is comprised of at least one tier, preferably more than one, each tier having a transport extending therethrough. A plurality of sort pockets are positioned along the transport and are adapted to receive the documents as they are diverted from the transport. Two (i.e. dual) feeder sections, one at each end of the stacker section, simultaneously feed documents onto the respective transports from both of said ends of the sort machine.

An induction buffer unit is provided at each end of the elongated stacker section to prevent a document already on a transport (i.e. a document fed by one of the dual feeders) from colliding with a document being fed onto the same transport from the other of the dual feeders. Each induction buffer unit has a turn-around pulley in the transport which allows a document from a first feeder and already on the transport to reverse direction after it has traveled the length of one side of the tier so that the document can reach its final destination when its designated sort pocket lies along the other side of the tier. Since a document from the second feeder enters the transport of the same tier at a point just downstream of the turn-around pulley, any collision between documents will likely occur at this point.

To prevent any such collision, a purge pocket is provided along the transport just upstream of the turn-around pulley. When it is sensed that a collision between documents is imminent, a gate in the buffer unit is actuated to divert the document already on the transport into which the purge pocket by doing so, both feeders can continue to feed documents from both ends of the sorter without interruption.

The present sort machine also has a document stacking or piggy-back section for stacking documents going to the same sort pocket wherein the combined thickness of the stacked documents are within a predetermined range. This section includes a thickness measuring device for measuring the thicknesses of all of the documents as they pass through the section and a bypass transport. The bypass transport is adapted (a) to receive and temporarily hold the first of two consecutive documents to the same designated pocket and each having a thickness less than the predetermined thickness and (b) for returning said first document to said transport to thereby stack or piggy-back the first document onto a second document for final transport to their common pocket.

BRIEF DESCRIPTION OF THE DRAWING

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents that may be included within the spirit and scope of the invention, as defined by the appended claims.

DESCRIPTION OF THE PREFERRED EMBODIMENTS

Figure 1:
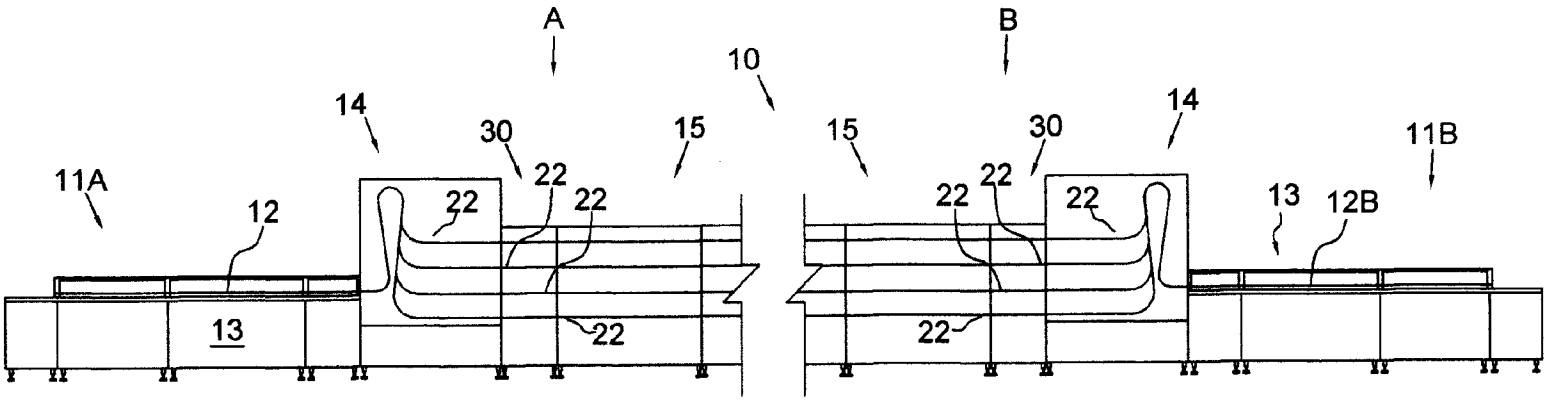
FIG. 1 is a simplified side view of the sort machine of the present invention can be incorporated.

Referring more particularly to the drawings, FIG. 1 is a plan view of a multi-tiered, document sort machine 10 in accordance with the present invention. As seen in FIG. 1, machine 10 is comprised of two halves A and B which are substantially identical so only one half will be described in detail. Each half (A and B) is comprised of a feeder section 11, a transport 12, a serpentine piggy-backing section 13, an elevator or Level Distribution Unit (LDU) 14, and multi-tiered stacker section 15.

Figure 2:
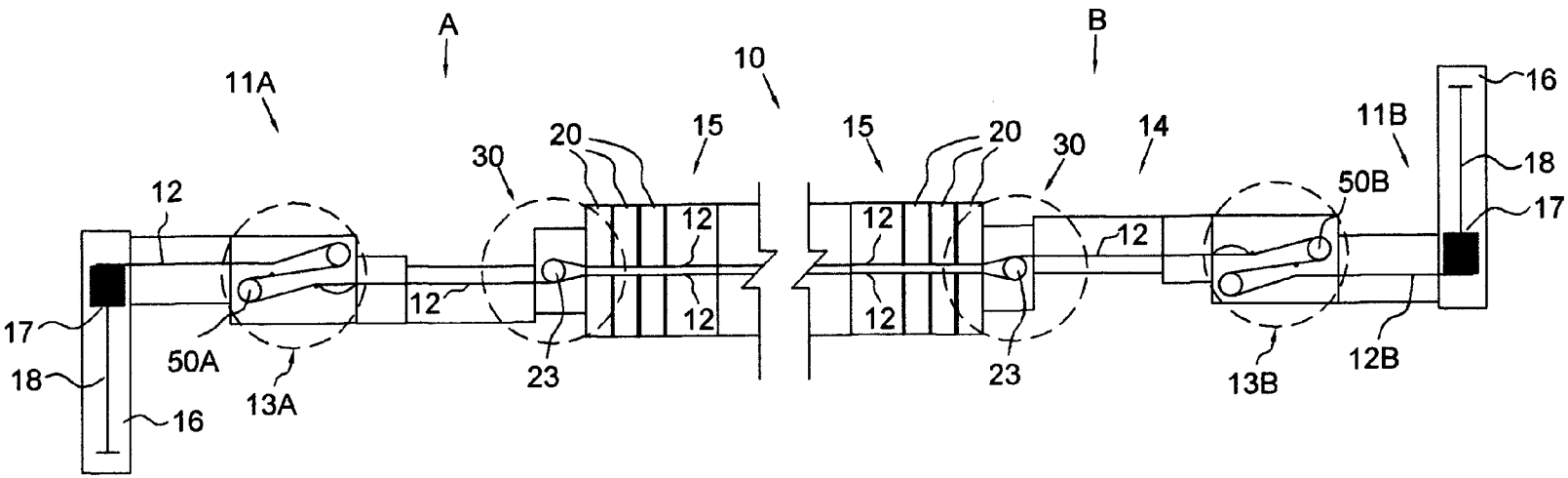
FIG. 2 is a top view of the sort machine shown in FIG. 1.

Each half (A and B) is comprised of a feeder section 11 having a magazine 16 (FIG. 2) onto which a batch of documents (e.g. letters or pieces 17) are positioned (see FIG. 2). Conveyor 18 (e.g. motor driven chain-link belts) feeds documents 17 forward onto a pickoff which picks off one document at a time and delivers it onto transport 12. As the document passes by optical character reader and/or bar code reader (not shown), an identifying mark, (e.g. a sort code such as a Zip Code or bar code, respectively) on the document 17 is read by the appropriate reader which, in turn, generates a signal representative of the mark as is well known in the art. These signals are then processed to direct that document through LDU 14 to its pre-assigned sort pocket on one of tiers 22 in stacker section 15. LDU's are well known in this art and many are now in use in commercially-available, multi-tier sorters.

Figure 3:
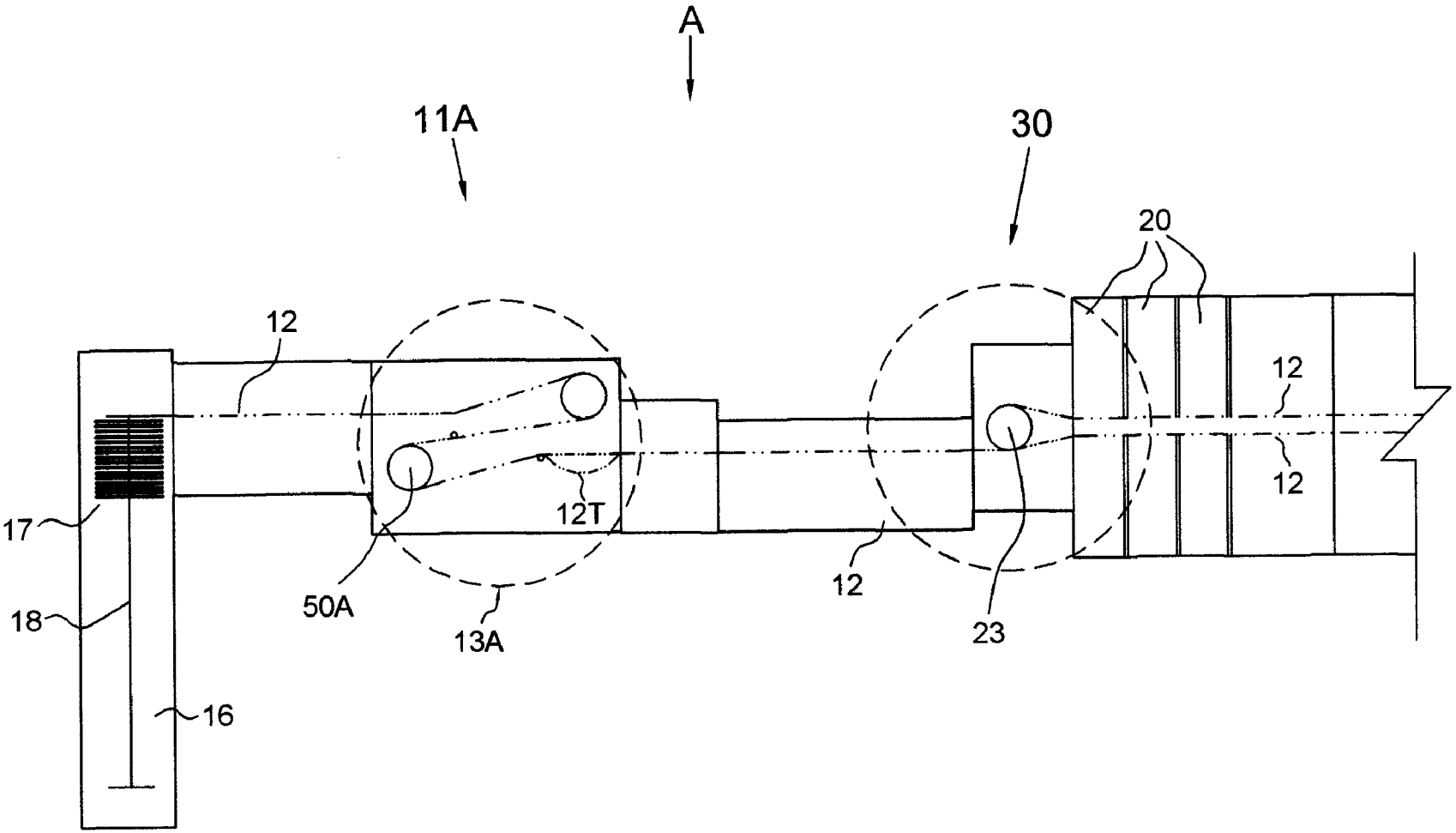
FIG. 3 is an enlarged view of one end of the sort machine of FIG. 1.

Stacker section 15 is shown as being comprised of a plurality (e.g. four) of vertically stacked tiers 22, each tier being substantially identical to the others. Each tier 22 has a plurality of horizontal stacker bins or "pockets" 20 (only some shown and numbered for clarity) arranged in pairs having one pocket on either side of the looped transport 12. As best seen in FIGS. 2 and 3, transport 12 on each tier 22 forms a continuous path or "carousel" which extend through both the adjacent stacker sections 15 of both A and B. That is, transport 12 passes around a "turn around" pulleys 23 at the opposite ends of the respective stacker sections so that a document may be carried along one side of the sort pockets, turned around, and then back along the other side of the sort pockets until the document reaches its designated pocket. While only two stacker sections are shown, it should be recognized that there may be more than two section aligned with each other or the two sections shown may be combined into a single stacker section without departing from the present invention.

Each pocket 20 has a diverter means (see 21*a* in FIG. 5; not shown in other FIGS. for the sake of clarity) which is actuated as a designated document 17 approaches its pocket. The diverter, when activated, temporarily intersect the centerline of transport 12 to thereby divert document 17 from transport 12 into its designated pocket 20. This type of operation is well known in commercially-available sort machines; e.g. Models NP8000, Vsort® and OMEGA® Mail Sorters, manufactured and distributed by National Presort, Inc., Dallas, Tex.

While the machine 10 will be shown and described as having four tiers 22, it should be recognized that more or less tiers (i.e. at least one) can be used without departing from the present invention. Also will be recognized, in most operations using multi-tiered sort machines, the sorting of the mail will be programmed to arrange the sort pockets so that each tier will receive approximately an equal amount of the documents. For example, in a four-tier machine, the designated pockets for a particular batch of documents will be assigned so that approximately 25% of the documents will be fed to each tier, leaving appropriate 75% of the available transport capacity of that tier unused.

In accordance with the present invention, dual feeders 11 are provided to feed documents onto transport 12 from opposite ends of the sort machine 10. That is, one feeder 11A reads and feeds documents from one end of the sorter 10 through its respective LDU 14 to each of the four tiers 22 while, at the same time, feeder 11B reads and feeds documents from the other end of the elongated sort machine 10.

As described above, a document 17 fed from either feeder 11A or 11B may have to travel almost all of the way around the looped transport 12 of a respective tier 22 in order to reach a designated pocket 20 which lies on the other side of the stacker section from which the document entered the transport. In order to do this, that document must travel completely through both stacker sections 15 along one side of the tier and then reverse directions at "turn around" pulley 23 in a respective induction buffer unit 30 before it can travel along the other side of the tier to reach its designated pocket.

Since documents 17 are being fed simultaneously from both feeders 11A and 11B onto respective ends of the respective common looped transport 12 of each respective tier 22, there is a real possibility that a document from one of the feeders and already in the transport may collide with a document being fed onto the transport by the other feeder; thereby causing a collision between the two documents. Any such collisions are likely to cause jamming in the transport that will result in a shut-down of sort operations to clear the jam. To prevent this from happening, an induction buffer unit 30 is provided at each end of each tier 22. Since the buffer units 30 are identical, only the unit at one end (i.e. 30B) will be described in detail.

Figure 4:
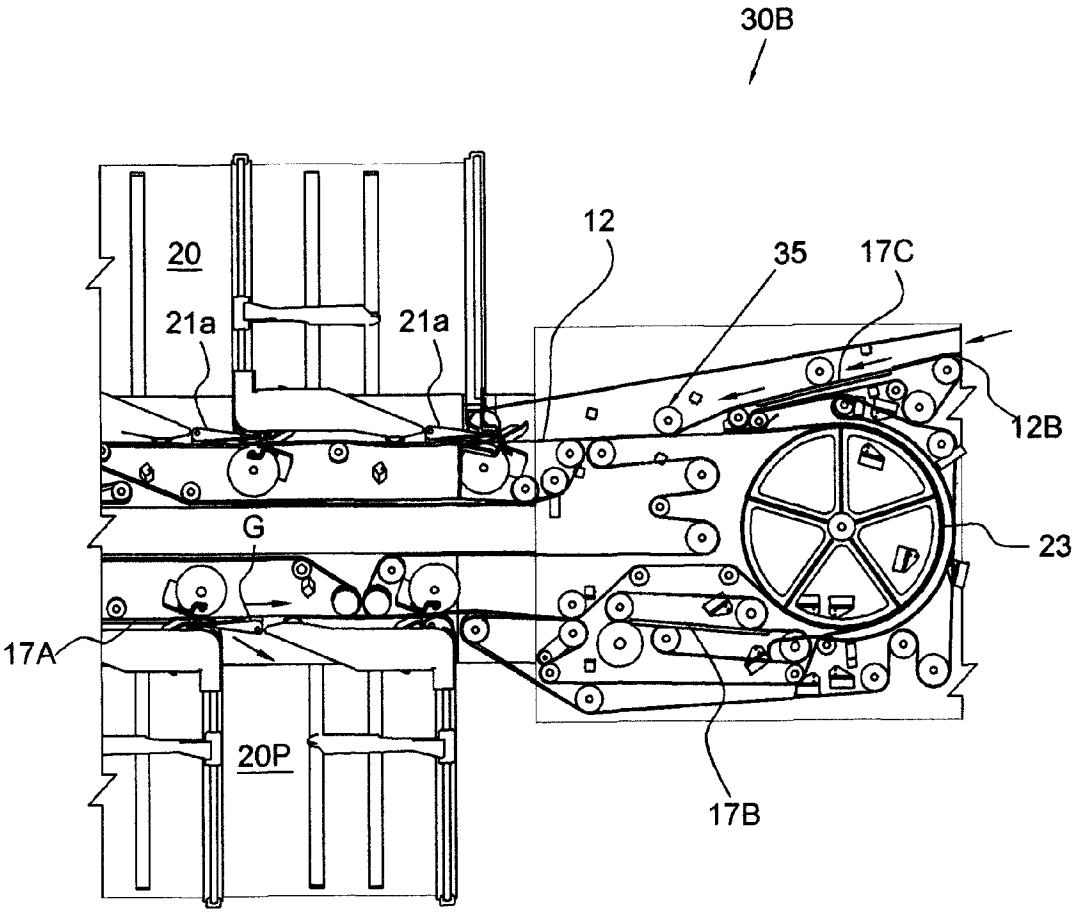
FIG. 4 is an enlarged, top view of the induction buffer unit at each end of each tier of the sort machine of FIG. 1.

As best seen in FIG. 4, buffer unit 30B includes transport 12B that feeds document 17C from feeder 11B into the looped or carousel transport 12 at one end of a respective tier 22. To prevent document 17C from colliding with document 17B already on transport 12 (e.g. one which has been fed from feeder 11A), a sensor(s) (not shown) along transport 12 determines when document 17B is likely to arrive at the merge point 35 at the same time as document 17C will enter transport 12. If the possibility of collision is imminent, document 17B is held in induction buffer unit 30 until document 17C enters transport 12 at point 35, at which time, document 17B is released to resume normal operation.

If a following document 17A is positioned on transport 12 so that it might run up onto the document 17B as it is being delayed in unit 30, gate G is actuated to divert document 17A into a "purge" pocket 20P. Any documents in purge pocket 20P are then removed and ran back through sort machine 10 to sort them into their proper pockets. This allows both feeders to continue to feed documents without interruption.

Figure 5:
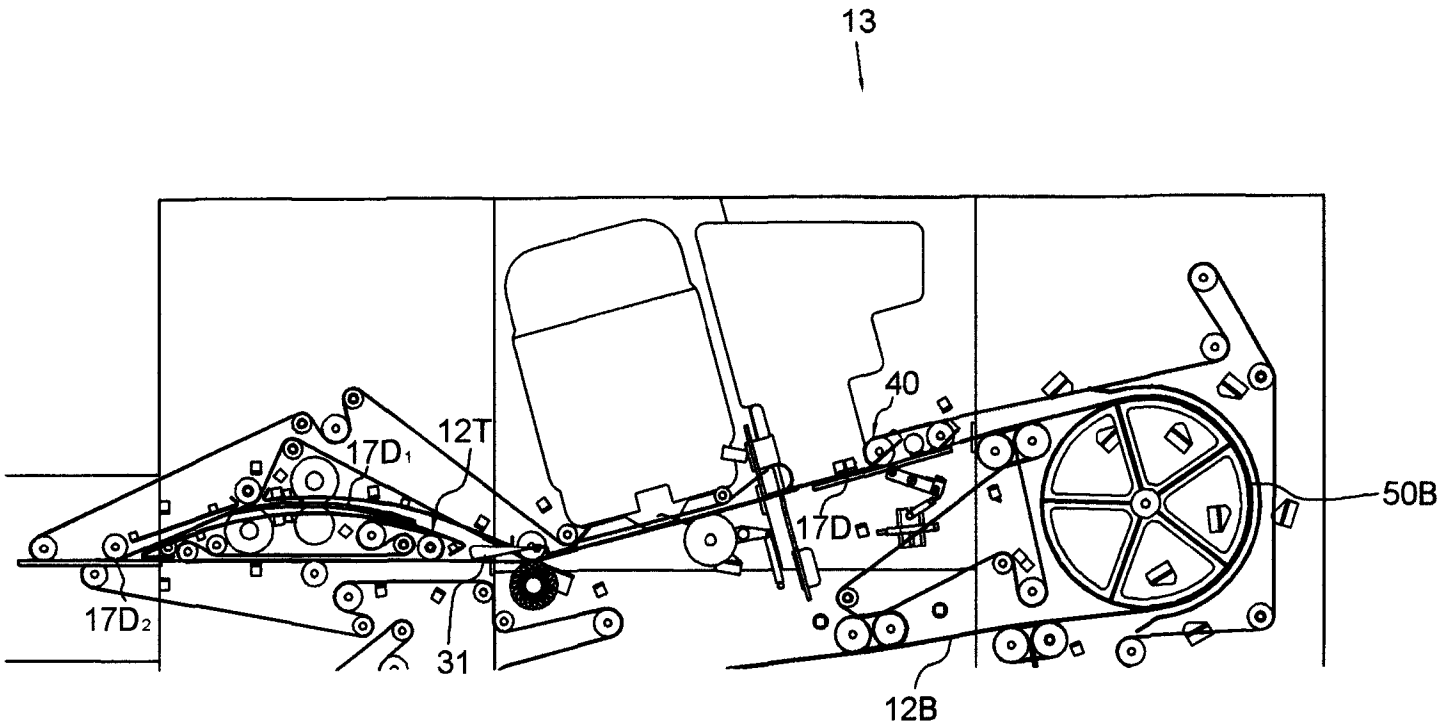
FIG. 5 is a enlarged, top view of the serpentine "piggy-backing" section at each end of the sort machine of FIG. 1.

Another feature of the present invention is serpentine piggy-back unit 13 (FIG. 5). The function of this unit is to stack or "piggy-back" consecutive documents going to the same designated pocket whose combined thicknesses are equal to or less than a predetermined thickness. Stacking such documents is highly beneficial since it reduces the number of times a gate at a particular pocket has to be actuated during the sort operation. Also, the piggy-backing of these documents leaves a gap on the transport which is also beneficial in merging the documents from the dual feeders.

In the operation of serpentine, piggy-back unit 13, the thickness of each document 17D (FIG. 5) is measured by any known thickness measuring device 40 as it passes through serpentine unit 13. Such devices are well known in the art and are available from several commercial sources. If the thickness of document 17D equals or exceeds a predetermined thickness, it passes on through unit 13 to its designated pocket in the stacker section. However, if the combined thicknesses of any two consecutive, adjacent documents 17D (i.e. documents going to the same sort pocket) is equal to or less than the predetermined thickness, the first document $17D_1$ is diverted into by-pass transport 12T by gate 31 and is temporarily held at that point.

When the following document 17$D_2$ (which is going to the same pocket as document 17$D_1$) approaches the exit of bypass transport 12T, document 17$D_1$ is fed (i.e. piggy-backed) onto document 17$D_2$. The two stacked documents will now travel along transport 12 as if a single document until it reaches its designated pocket and is sorted accordingly.

What is claimed is:

1. A document sorting machine comprising:

an elongated stacker section having two ends, said elongated stacker section comprising:

a transport extending through said stacker section;

a plurality of sort pockets positioned along said transport;

two feeder sections, one at each end of said elongated stacker section for feeding documents onto said transport of said stacker section from both of said ends of said stacker section;

wherein said elongated stacker section includes:

an induction buffer unit at each said end of said elongated stacker section for preventing a collision between documents being fed onto said transport from said two feeder sections;

wherein said induction buffer unit comprises:

a turn-around pulley at a respective end of said stacker section and forming part of said transport;

a purge pocket upstream of said turn-around pulley; and a gate to divert a document from said transport into said purge pocket to prevent a collision with a document being fed onto said transport at a point downstream of said turn-around pulley.

2. The document sorting machine of claim 1 including:

a document stacking unit comprising:

thickness measuring device for measuring the thicknesses of said documents on said transport; and a bypass transport for receiving and temporarily holding a first document wherein said first document is destined for a particular designated pocket and has a thickness less than a predetermined thickness and for returning said first document to said transport to thereby stack said first document onto a second document going to said same particular designated pocket.

3. The document sorting machine of claim 2 wherein said second document has a thickness less than said predetermined thickness and is the document immediately following said first document on said transport.

4. A document sorting machine comprising:

a stacker section, said stacker section comprising:

at least one elongated tier having two ends and comprising:

a transport extending through said tier;

a plurality of sort pockets positioned along said transport; and two feeder sections, one at each end of said stacker section for feeding documents onto said transport from both ends of said stacker section;

wherein said at least one elongated tier comprises:

a plurality of elongated tiers;

wherein said a plurality of elongated tiers are vertically stacked one over the others;

a level distribution unit for directing documents to a particular tier;

wherein said elongated stacker section includes:

an induction buffer unit at each said end of said tier for preventing a collision between documents being fed onto said transport of said tier from said two feeder sections; and wherein said induction buffer unit comprises:

a turn-around pulley at a respective end of said stacker section and forming part of said transport;

a purge pocket upstream of said turn-around pulley; and a gate to divert a document from said transport into said purge pocket to prevent a collision with a document being fed onto said transport at a point downstream of said turn-around pulley.

5. The document sorting machine of claim 4 including:

a document stacking unit comprising:

thickness measuring device for measuring the thicknesses of said documents on said transport; and a bypass transport for receiving and temporarily holding a first document wherein said first document is destined for a particular designated pocket and has a thickness less than a predetermined thickness and for returning said first document to said transport to thereby stack said first document onto a second document going to said same particular designated pocket.

6. The document sorting machine of claim 5 wherein said second document has a thickness less than said predetermined thickness and is the document immediately following said first document on said transport.

* * * * *